US007687697B2

(12) United States Patent
Ognibeni

(10) Patent No.: US 7,687,697 B2
(45) Date of Patent: Mar. 30, 2010

(54) SOUND PANEL FOR PLAYING SOUNDS AND MUSIC, AND METHOD FOR MANUFACTURING SUCH PANEL

(75) Inventor: Fabio Ognibeni, Tesero (IT)

(73) Assignee: Enrico Ciresa S.R.L., Tesero (IT)

( * ) Notice: Subject to any disclaimer, the term of this patent is extended or adjusted under 35 U.S.C. 154(b) by 542 days.

(21) Appl. No.: 11/442,340

(22) Filed: May 30, 2006

(65) Prior Publication Data

US 2006/0278066 A1 Dec. 14, 2006

(30) Foreign Application Priority Data

Jun. 13, 2005 (IT) ..... MI2005A1106

(51) Int. Cl.
*G10D 13/08* (2006.01)

(52) U.S. Cl. ..... 84/291; 84/402; 84/403; 84/411 R

(58) Field of Classification Search ..... 84/291
See application file for complete search history.

(56) References Cited

U.S. PATENT DOCUMENTS 3,908,503 A 9/1975 Bolin
4,486,371 A * 12/1984 Caliri ..... 264/78
5,686,679 A * 11/1997 Nakano et al. ..... 84/402
6,298,140 B1 * 10/2001 Manavopoulos ..... 381/152

FOREIGN PATENT DOCUMENTS

| | | | |
|---|---|---|---|
| GB | 336 766 | A | 10/1930 |
| GB | 1 278 284 | A | 6/1972 |
| WO | WO 97/09842 | A | 3/1997 |
| WO | WO 99/31652 | A | 6/1999 |
| WO | WO 00/13464 | A | 3/2000 |
| WO | WO 00/15000 | A | 3/2000 |
| WO | WO 00/54250 | A | 9/2000 |

* cited by examiner

*Primary Examiner*—Jeffrey Donels
*Assistant Examiner*—Christopher Uhlir
(74) *Attorney, Agent, or Firm*—Modiano & Associati; Albert Josif; Daniel J. O'Byrne

(57) ABSTRACT

A sound panel for playing sounds and music, comprising a substantially flat soundboard made of wood, at least one tie which is fitted to the soundboard in order to subject the soundboard to a mechanical tension, an electromechanical transducer which is mounted on the soundboard in a nodal vibration point of the soundboard and can be connected to an electronic audio source in order to transduce into mechanical pulses and consequent vibrations of the soundboard audio information that arrives from the electronic audio source in the form of electrical signals, the soundboard comprising areas having mutually different thicknesses in order to evenly distribute transfer of energy from the soundboard to the air over a range of sound frequencies.

7 Claims, 3 Drawing Sheets

SOUND PANEL FOR PLAYING SOUNDS AND MUSIC, AND METHOD FOR MANUFACTURING SUCH PANEL

The present invention relates to a sound panel for playing sounds and music and to the method for manufacturing such panel. More particularly, the invention relates to a sound panel made of wood, which can be connected to an audio source in order to play sounds and music generated by such audio source, which can be of any kind, for example a CD player, a radio, a magnetic tape player or a mixer.

BACKGROUND OF THE INVENTION

It is known to use loudspeakers to reproduce and play music. Loudspeakers typically comprise a thin cone-shaped diaphragm, which is mounted within a resounding chamber and is connected to an electromagnetic transducer of the coil type in its central part in order to generate sound waves along the surface of the diaphragm.

However, these loudspeakers suffer the drawback that they can work only within a limited frequency range, and it is therefore necessary to use a number of diaphragms in the same loudspeaker or in a plurality of loudspeakers in order to enhance certain groups of frequencies, for example low, medium and high frequencies.

Moreover, it is necessary to use a resounding chamber in order to avoid the effects of destructive interference of the sounds generated by the diaphragm.

SUMMARY OF THE INVENTION

The aim of the present invention is to obviate the drawbacks cited above by proposing a type of loudspeaker which is capable of playing sounds and music generated by any electronic source.

Within this aim, an object of the invention is to provide a sound panel which can play sounds and music faithfully, like a musical instrument.

Another object of the invention is to provide a sound panel which is not excessively subject to stresses which compromise its normal operation.

Moreover, an object of the present invention is to minimize the acoustomechanical impedance of the sound panel.

A further object of the present invention is to create panels which are aesthetically pleasant and adaptable to any environment.

Still another object of the invention is to provide a sound panel which is highly reliable, relatively easy to manufacture, and at competitive costs.

This aim and these and other objects, which will become better apparent hereinafter, are achieved by a sound panel for playing sounds and music, according to the invention, characterized in that it comprises a soundboard made of wood, at least one tie which is fitted to the soundboard in order to subject said soundboard to a mechanical tension, an electromechanical transducer which is mounted on the soundboard in a nodal vibration point of the soundboard and can be connected to an electronic audio source in order to transduce into mechanical pulses and consequent vibrations of the soundboard audio information that arrives from the electronic audio source in the form of electrical signals, said soundboard comprising areas having mutually different thicknesses in order to evenly distribute the transfer of energy from the soundboard to the air over a range of sound frequencies.

Advantageously, in the preferred embodiment there is a sound and music playback apparatus characterized in that it comprises said sound panel and a conversion circuit which is connected to the transducer mounted in the panel and connectable to one or more loudspeaker outputs of an electronic sound source, in order to transduce into mechanical pulses and consequent vibrations of the soundboard audio or musical information arriving from the electronic audio source in the form of electrical signals.

The aim and objects of the invention are also achieved by a method for manufacturing a sound panel for playing sounds and music, characterized in that it comprises the steps of:

- building a soundboard made of wood which is substantially flat and has a preset shape;
- determining an intrinsic vibration frequency of the soundboard;
- determining a nodal vibration point of the soundboard:
- performing a frequency mapping on the surface of the soundboard in order to determine peaks of intensity in a range of audio frequencies along the surface of the board;
- changing the thickness of regions of the board which are selected according to the value of the peaks of intensity obtained at the various frequencies;
- applying at least one tie to the soundboard so as to subject the soundboard to mechanical tension;
- applying an electromechanical transducer, preferably of the bimorphic piezoceramic type, at the determined nodal point, in order to transduce into mechanical pulses and consequent vibrations of the soundboard audio information arriving from the electronic sound source in the form of electrical signals.

BRIEF DESCRIPTION OF THE DRAWINGS

Further characteristics and advantages of the invention will become better apparent from the description of preferred but not exclusive embodiments of the panel and of the manufacturing method according to the invention, illustrated by way of non-limiting example in the accompanying drawings, wherein.

DESCRIPTION OF THE PREFERRED EMBODIMENTS

Figure 1:
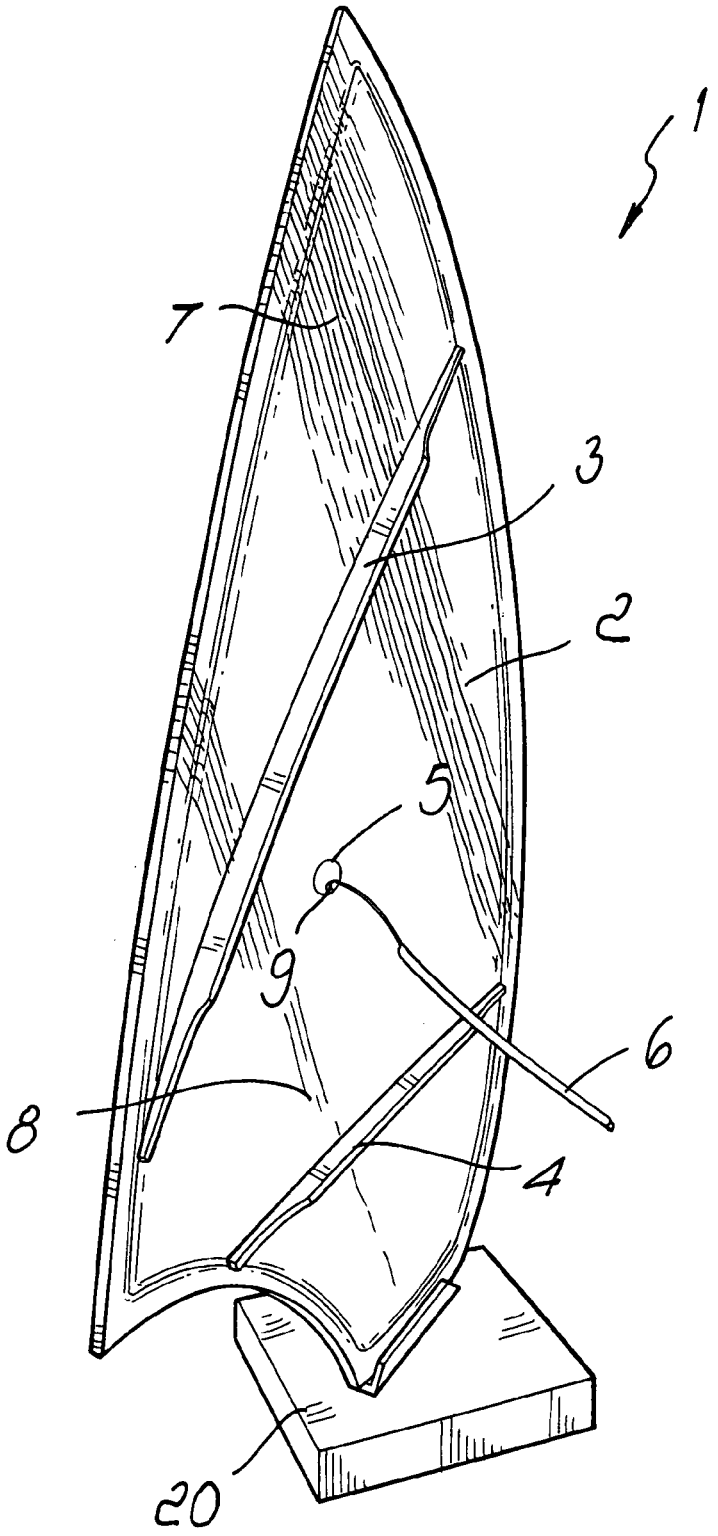
FIG. 1 is a perspective view of a sound panel according to a first embodiment of the invention.

With reference to the figures, the sound panel according to the invention, generally designated by the reference numeral 1, comprises a soundboard 2 made of wood, preferably fir, even more preferably Val di Fiemme fir.

Of course, the soundboard can be made of any material or of any wood, so long as it is of the type used in luthier's workshops or workshops for making soundboards for musical instruments in general.

The soundboard 2 is composed of a plurality of wooden strips, which are glued together so as to form a substantially flat structure which has a preset shape.

Figure 2:
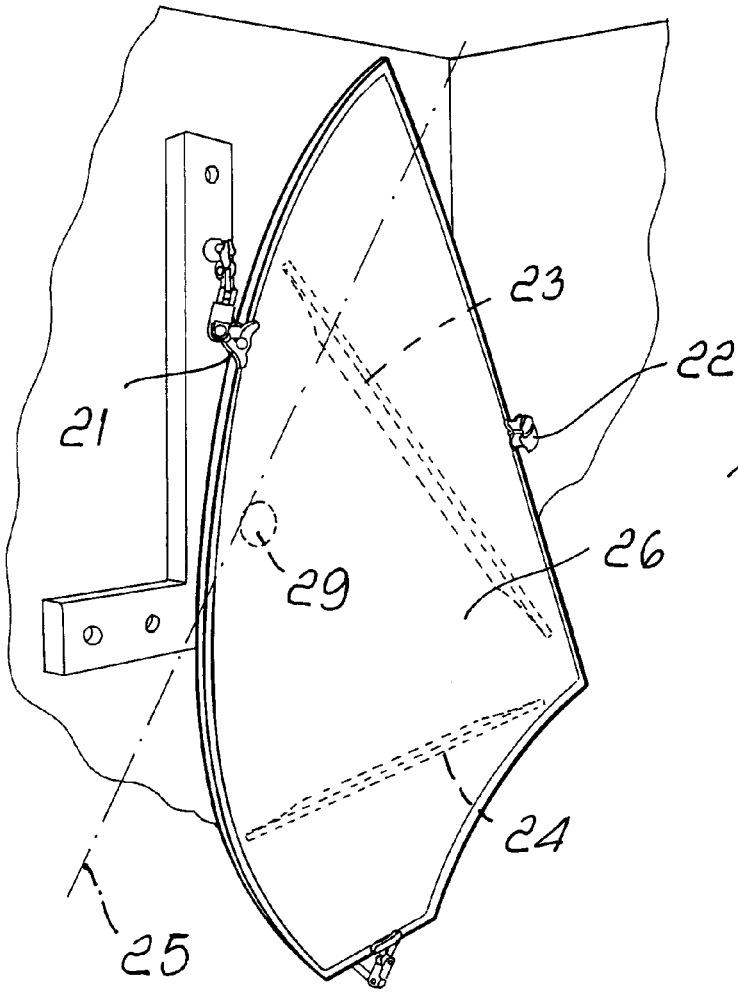
FIG. 2 is a perspective view of a sound panel according to a second embodiment of the invention.
Figure 3:
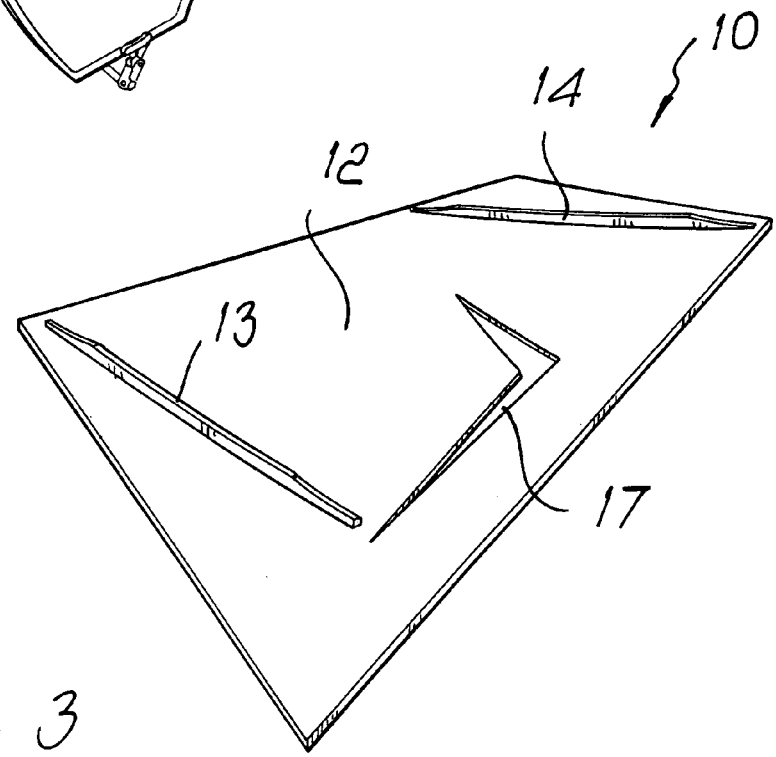
FIG. 3 is a perspective view of a sound panel according to a third embodiment of the invention.
Figure 4:
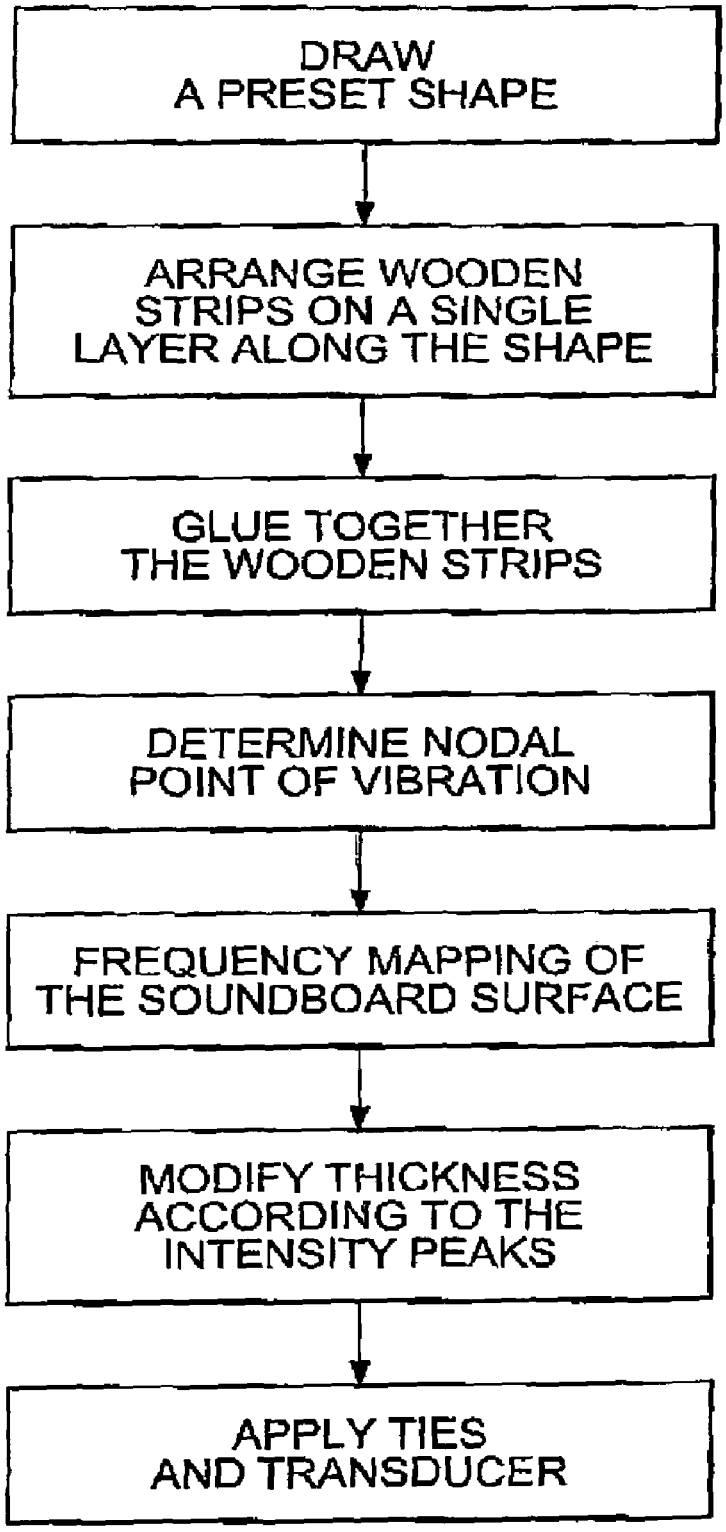
FIG. 4 shows a method for manufacturing a sound panel according to the invention.

The wooden strips are arranged preferably so that the fiber of the wood of which they are made is oriented substantially along a long side or a long diagonal of the shape of the soundboard, for example along the main direction or along a main diagonal thereof, for example along a direction 25 as shown in FIG. 2.

Moreover, the wooden strips are produced by cutting along planes which are parallel to a substantially radial direction of a fir trunk, so that the grain is approximately perpendicular to the main surface of the strip, in order to obtain soundboards which do not tend to warp due to humidity.

The soundboard 2 is mounted on a base 20, and comprises at least one and preferably two ties 3 and 4 are which are glued thereon and are arranged along substantially radial or transverse directions with respect to the direction of the fiber of the wood. The ties, also preferably made of fir, have such dimensions and radius of curvature as to apply a mechanical tension to the soundboard 2. The number of ties can of course be other than two, depending on the requirements and the dimensions of the soundboard.

In a second embodiment of the invention, the sound panel 26, with two ties 23 and 24, is adapted to hang from a wall, by means of suitable clamps 21 and 22 provided with shock absorbers, in order to keep the panel hanging approximately 8-10 centimeters from the wall. The panel can of course be hung in different manners, but it is in any case preferable for the means that fix the panel to the wall or ceiling to be provided with means for damping vibrations and preventing their transmission from and toward the panel.

A sound panel 10 according to a third embodiment of the invention comprises, in addition to a soundboard 12 and ties 13 and 14, an opening 17, which is formed in the soundboard in order to give it additional timbre properties.

Going back to the sound panel shown in FIG. 1, the soundboard 2 has a seat 5, which is formed inside it in a nodal point of a vibrating mode of the soundboard, which is determined as will be described hereinafter. The nodal point where the seat 5 is located can be arranged in a substantially central position of the soundboard, as shown in FIG. 1, but this position can vary according to the dimensions and shape of the board. For example, a nodal point can be present in the vicinity of the edge of the soundboard, as in the case of FIG. 2.

An electromechanical transducer 9 (29 in FIG. 2) is inserted within the seat 5 and is capable of applying mechanical vibrations to the soundboard 2 when it is powered by a suitable electroacoustic signal, which reproduces the sound that arrives from the audio source.

In the preferred embodiments, the transducer 9 is a bimorphic piezoceramic bender, for example of the type marketed by the Japanese company Fuji and Co. of Osaka (http://fuji-piezo.com), which by means of a bimorphic piezoceramic disk measuring approximately 50 mm in diameter is capable of producing mechanical movements of substantially more than 200μ in a frequency range ranging from approximately 60 to approximately 16000 Hz, with a blocking force (the maximum force that can be produced by the individual actuator, i.e., the blocking force required in order to reduce maximum movement to zero) ranging from approximately 6 N to approximately 20 N and a supply voltage ranging from approximately 70 V to approximately 100 V.

The transducer 9 is connected, by means of a cable 6, to an audio conversion circuit, which in turn is connected to the audio output of an audio source, such as for example the analog audio output of a music CD player, not shown in the figures.

The conversion circuit is preferably separated from the sound panel 1 and is adapted to transduce into mechanical pulses and consequent vibrations of the soundboard acoustic or musical information that arrives from said electronic audio source in the form of electrical signals.

In particular, the circuit comprises a stage for conversion and adaption to the mains voltage, which is composed preferably of a grain-oriented transformer with a triple secondary winding at very low voltage, a fuse protection element, a power-on switch and the cable for connection to the electrical mains.

In order to filter and stabilize the signal, a stage is used which comprises a Graetz bridge rectifier, leveling capacitors and monolithic linear voltage stabilizers for dual voltage with devices for setting manually the output voltage. The conversion circuit further comprises a stage for adapting and equalizing the input audio signal, which comprises a passive adaptive input network and a five-band analog integrated circuit with individual manual adjustment.

Moreover, a low-frequency solid-state amplifier stage is provided which is composed of a class AB monolithic linear amplifier circuit with MOSFET final transistors, a digital muting circuit and an SOA protection circuit.

Finally, the conversion circuit is preferably completed by a muting or standby function control logic system, which has a bistable CMOS memory circuit and a LED which indicates the status of "standby".

The electromechanical transducer 9 is used to transfer energy to the soundboard in the form of vibrations, converting into mechanical pulses electrical signals which represent said audio information emitted by an audio or musical source.

In order to optimize the transfer of energy within the wood of the panel 1, the soundboard 2 comprises one or more acoustic regions with uneven thickness or with mutually different thicknesses, which can vary preferably from 1.2 to 6.3 mm approximately, in order to provide a more uniform transfer of energy from the soundboard to the air in an audio frequency range. FIG. 1 illustrates, by way of example, an area 7 with reduced thickness and an area 8 with increased thickness.

The thicknesses of the areas are sized and provided according to classic luthier's techniques and preferably by following the operations listed below.

The shape and dimensions of the panel are selected starting from a theme on which a paper model is to be created bearing in mind that the direction of the long side or of a long diagonal of the shape substantially coincides with the direction of the wood fiber. The soundboard is in fact subject to flexing along these directions.

After creating the paper model, the soundboard is built by arranging, on a single layer, strips of wood, preferably fir or even more preferably Fiemme fir, selected so that the fiber is substantially perpendicular or in any case not parallel to the larger surface of the strips, as mentioned above. Each strip can have, merely by way of example, a width of 7-8 cm, a thickness of 7-9 mm and a length of approximately 120 cm in the direction of the fiber.

The rough shape of the sound panel thus obtained is glued and calibrated to a thickness of approximately 8.5 mm in order to allow inlaying on the edge and the consequent insertion of a wood fillet used normally in the manufacture of soundboards for musical instruments.

Following the inlay and filleting operations, the soundboard is again calibrated to a thickness which preferably ranges from 4.5 to 6.5 mm, so that it is perfectly flat.

Then, by means of a sound frequency reading instrument and by way of means for striking the soundboard, tests are carried out in order to determine the intrinsic vibration frequency of the soundboard having the preset shape. A frequency mapping is then performed on the surface of the soundboard in order to determine the peaks of intensity of vibration at the various audio frequencies along the surface of the soundboard.

As an alternative, as occurs in classical lute-making techniques, the mapping of the soundboard can be performed by striking the soundboard in different points thereof and, for each point, placing a tuning fork in order to measure the response and mark on the board the points where the measurement was taken.

Other mapping techniques can be used as an alternative, as the person skilled in the art can easily understand.

Performing the mapping also determines, the excitation point where it will be necessary to apply the electromechanical transducer, also preparing the seat in which it will be inserted. The position is selected in a nodal point of vibration of the soundboard in which the transfer of energy to the soundboard is the best.

Depending on the results of the mapping, the thicknesses of the soundboard are designed in the measured areas so as to balance the sound intensity at the various frequencies and minimize the acoustomechanical impedance of the soundboard. A reduction in thickness entails an enhancement of low-frequency tones, whereas the use of ties enhances the high frequencies.

By using small ties, here referenced as secondary ties, it is possible to transfer advantageously vibration energy from particularly rich acoustic areas of the soundboard to poorer acoustic areas, in terms of vibration intensity in a sound frequency band.

The back of the board is then sculpted where it is necessary to decrease the thicknesses and the ties are shaped. The ties are then glued onto templates which are preformed for the individual soundboard and polishing of all the surfaces is performed.

The ties preferably have a size ranging from approximately 120 mm to 780 mm, with thicknesses ranging from 4.5 mm to 8 mm and a height ranging from 4 to 13 mm. Their radius of curvature is such as to give the soundboard a load ranging from 1 to 9 mm in terms of transverse camber.

At least one additional sound test is then performed again and the response of the soundboard is refined by modifying manually the thickness and/or shaping the ties until the best result in terms of acoustomechanical impedance (which must be minimized) and of energy transfer within the wood is achieved. The ties are sized so that they give the right degree of tension to the soundboard and help the transfer of energy in the radial direction of the wood fibers.

Finally, the sound panel is varnished, polished and finished, the piezoceramic bender 9 is inserted permanently in its seat 5, and the wires of the cable 6 are welded to the bender 9, which is fixed by means of adhesive in its seat of the soundboard 2 and is protected by a wooden plug.

Preferably, additional final tests on the sound panel are then performed and the characteristic spectrum of its frequency response is recorded.

Once the sound panel has been built by using the method according to the invention, sound panels having the same shape and dimensions can be manufactured and duplicated easily, although sound personalities which are characteristic of each individual panel are obtained, as occurs in identical musical instruments, thus reducing the number of tests to be performed.

In practice it has been found that the device according to the invention fully achieves the intended aim and objects.

The device thus conceived is susceptible of numerous modifications and variations, all of which are within the scope of the appended claims. All the details may further be replaced with other technically equivalent elements.

In practice, the materials used, as well as the dimensions, may be any according to requirements and to the state of the art.

The disclosures in Italian Patent Application No. MI2005A001106 from which this application claims priority are incorporated herein by reference.

What is claimed is:

1. A method for manufacturing a sound panel for playing sounds and music, characterized in that it comprises the steps of:

building a soundboard out of wood, which is substantially flat and has a preset shape, said building comprising: drawing said preset shape, gluing together a plurality of wooden strips arranging them on a single layer so as to form substantially the drawn preset shape and so that the fiber of the wood is substantially directed along a long side or a long diagonal of the drawn preset shape, the grain of said wooden strips being not parallel to the larger surface of the strips;

determining an intrinsic vibration frequency of the soundboard;

determining a nodal point of vibration of the soundboard;

performing a frequency mapping on the surface of the soundboard in order to determine peaks of intensity in an audio frequency range along the surface of the soundboard;

modifying the thickness of areas of the soundboard selected according to the value of the peaks of intensity obtained at the various frequencies;

applying, to said soundboard, at least one tie having such a dimension and radius of curvature as to apply a mechanical tension to said soundboard;

forming a seat inside the soundboard in said nodal point;

mounting an electromechanical transducer within said seat, in order to transduce into mechanical pulses and consequent vibrations of the soundboard audio information which arrives from an electronic audio source in the form of electrical signals.

2. The method according to claim 1, characterized in that it comprises, after said gluing step, the steps of:

calibrating the soundboard to a first thickness;

inlaying the edge of the soundboard and inserting a wooden fillet along the edge of the soundboard;

calibrating the soundboard to a second uniform thickness which is lower than the first thickness.

3. The method according to claim 1, characterized in that said step of performing a frequency mapping comprises the steps of:

vibrating the soundboard at the audio frequencies of said frequency range;

measuring the intensity of the vibration on each of said plurality of areas for each one of said audio frequencies.

4. The method according to claim 1, characterized in that it further comprises the step of shaping said ties.

5. The method according to claim 1, characterized in that it repeats said step of determining the intensity peaks for the areas of the soundboard the thickness whereof has been modified.

6. The method according to claim 1, wherein the thickness of the selected areas is selected so as to optimize the energy transfer from the sound panel to the air.

7. The method according to claim 1, wherein said electromechanical transducer is of the bimorphic piezoceramic type.

* * * * *